US010388480B2

(12) United States Patent
Still et al.

(10) Patent No.: US 10,388,480 B2
(45) Date of Patent: Aug. 20, 2019

(54) DUAL ELEMENT FUSE AND METHODS OF MANUFACTURE

(71) Applicant: EATON INTELLIGENT POWER LIMITED, Dublin (IE)

(72) Inventors: Frederick Eugene Still, El Paso, TX (US); Abraham Joshua Miller, Chihuahua (MX); Gilberto Jaquez, Ciudad Juarez (MX)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/240,548

(22) Filed: Aug. 18, 2016

(65) Prior Publication Data

US 2018/0053617 A1 Feb. 22, 2018

(51) Int. Cl.

| | |
|---|---|
| ***H01H 85/055*** | (2006.01) |
| ***H01H 85/20*** | (2006.01) |
| ***H01H 85/175*** | (2006.01) |
| ***H01H 85/06*** | (2006.01) |
| ***H01H 85/08*** | (2006.01) |
| *H01H 85/00* | (2006.01) |

(52) U.S. Cl.

CPC ..... *H01H 85/055* (2013.01); *H01H 85/06* (2013.01); *H01H 85/08* (2013.01); *H01H 85/175* (2013.01); *H01H 85/202* (2013.01); *H01H 2085/0004* (2013.01)

(58) Field of Classification Search

CPC ..... H01H 85/055; H01H 85/20; H01H 85/08; H01H 85/202; H01H 85/06; H01H 85/175; H01H 2085/0004

USPC ..... 337/350, 292

See application file for complete search history.

(56) References Cited

U.S. PATENT DOCUMENTS 1,353,123 A * 9/1920 Kries ..... H01H 85/0456 337/225
2,159,423 A * 5/1939 Bussmann ..... H01H 85/0445 337/144
2,300,142 A * 10/1942 Wood ..... H01H 85/36 337/164
2,399,037 A * 4/1946 Jones ..... H01H 85/42 337/164
2,667,551 A * 1/1954 Berthel ..... H01H 85/044 337/166
2,787,684 A * 4/1957 Laing ..... H01H 85/0458 337/164
2,790,049 A * 4/1957 McAlister ..... H01H 37/761 337/405
3,701,069 A * 10/1972 Belcher ..... H01H 85/0458 337/160

(Continued)

OTHER PUBLICATIONS

Fusetron Energy Efficient, Dual-element, Time-delay Fuses; Low Voltage, Branch Circuit Rated Fuses; Cooper Bussmann; undated; 1 page.

*Primary Examiner* — Anatoly Vortman
(74) *Attorney, Agent, or Firm* — Armstrong Teasdale LLP

(57) ABSTRACT

A dual element electrical fuse includes at least one high overcurrent fusible element and a low overcurrent fusible element connected to one another inside a housing. The low overcurrent fusible element includes a single sided circuit board and a releasable conductive element that more simply provides low overcurrent protection and manufacturing efficiency with improved quality.

19 Claims, 3 Drawing Sheets

(56) References Cited

U.S. PATENT DOCUMENTS

| | | | | | |
|---|---|---|---|---|---|
| 3,968,468 | A * | 7/1976 | Andersen | H01H 61/002 | 29/622 |
| 4,053,861 | A * | 10/1977 | Knapp, Jr. | H01H 85/046 | 337/165 |
| 4,356,478 | A * | 10/1982 | Muggli | G08B 17/06 | 337/140 |
| 5,355,110 | A * | 10/1994 | Ruggiero | H01H 85/36 | 337/161 |
| 5,612,662 | A * | 3/1997 | Drekmeier | H01H 37/761 | 29/623 |
| 5,896,080 | A * | 4/1999 | Chen | H01H 37/761 | 337/401 |
| 5,920,251 | A * | 7/1999 | Shea | H01H 9/42 | 337/111 |
| 7,864,024 | B2 * | 1/2011 | Schlenker | H01H 37/761 | 337/239 |

* cited by examiner

DUAL ELEMENT FUSE AND METHODS OF MANUFACTURE

BACKGROUND OF THE INVENTION

The field of the invention relates generally to electrical fuse devices and methods of manufacturing electrical fuses, and more specifically to dual-element, time-delay fuses and methods of manufacturing the same.

Fuses are widely used as overcurrent protection devices to prevent costly damage to electrical circuits. Fuse terminals typically form an electrical connection between an electrical power source or power supply and an electrical component or a combination of components arranged in an electrical circuit. One or more fusible links or elements, or a fuse element assembly, is connected between the fuse terminals, so that when electrical current flow through the fuse exceeds a predetermined limit, the fusible elements melt and open one or more circuits through the fuse to prevent electrical component damage.

So-called dual-element, time-delay fuses are known that include a high overcurrent fuse element and a low overcurrent fuse element inside a housing of the fuse. The low overcurrent fuse element includes a device, often referred to in the art as a fuse trigger, that will electrically open a circuit path through the low overcurrent fuse element during an overload condition after a specified amount of time. Such fuses are effective to prevent electrical overload conditions from passing to upstream fuses in an electrical power system that would otherwise not cause the high overcurrent fuse element to open, and facilitate selective coordination of overcurrent protection devices to ensure reliability of electrical power systems supplying power to vital loads.

Conventional designs for trigger devices in dual-element, time-delay fuses present a number of challenges from a manufacturing perspective, and improvements are desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Exemplary embodiments of dual element, time delay fuses are described herein that beneficially may be manufactured from a reduced number of parts, with lower cost and improved reliability relative to conventional dual element, time delay fuses. Method aspects will be in part apparent and in part explicitly discussed in the following description.

Certain types of dual element, time delay fuses include helical spring-loaded trigger mechanisms that typically involve a relatively high number (e.g., eight) component parts that are typically assembled by hand. In electrical overcurrent conditions, the helical spring, which may be loaded in tension, causes a contact member to become dislodged when a fusible alloy is sufficiently heated by electrical current. The heat generated melts and weakens the mechanical connection, established by the fusible alloy, of the contact element in the trigger assembly. While functionally effective to open a circuit through the fuse in a low overcurrent condition, the hand assembly of the components is relatively difficult, time consuming and expensive to complete. Hand assembly of the components also tends to present undesirable performance variation and reliability issues over a large number of fuses. Lower cost and more readily manufacturable trigger mechanisms via automated techniques are desired.

Figure 1:
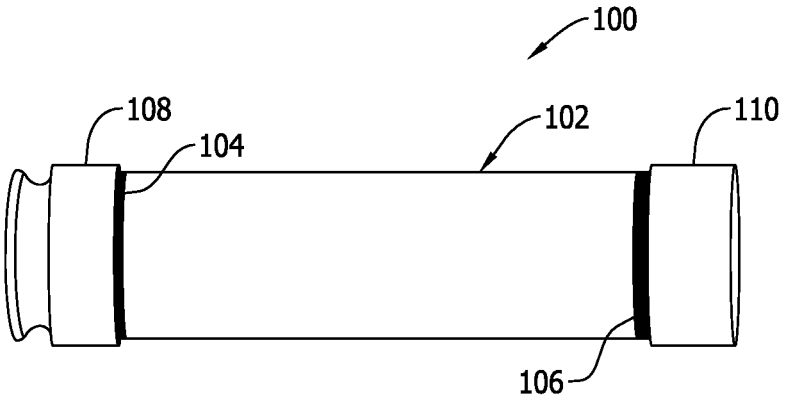
FIG. 1 is side elevational view of a dual element, delay fuse according to an exemplary embodiment of the present invention.

FIG. 1 is side elevational view of a dual element, delay fuse 100 according to an exemplary embodiment of the present invention. The fuse 100 generally includes a non-conductive housing 102 including opposing ends 104 and 106, and terminal elements 108, 110 coupled to the housing 102 on the ends 104, 106. Inside the housing 102 is a fuse element assembly 120 (FIGS. 2-5) connected to and defining a conductive circuit path between the fuse terminal elements 108, 110 so that when electrical current flow through the fuse 100 exceeds a predetermined limit, the fuse element assembly melts and opens at one or more locations such that it can no longer carry current through the fuse 100. As a result of opening of the fuse element assembly, an open circuit is created inside the fuse housing 102 between the terminals 108, 110 and any related circuits connected through the fuse 100 to prevent electrical component damage in an electrical power system.

In the illustrated example, the housing 102 is provided in the form of a substantially cylindrical, elongated and hollow tube. It is recognized, however, that other shapes of fuse housings may likewise be utilized, including but not necessarily limited to rectangular housings, in other embodiments as desired. Further, in the illustrated example, the terminal elements 108, 110 are provided in the form of end caps coupled to the respective ends 104, 106 of the housing 102 and extend in respectively opposite directions to one another, although other terminal arrangements and orientations including knife blade contacts, terminal blades and the like may instead be employed in alternative embodiments at different locations on the housing without limitation so long as the terminal elements 108, 110 effectively facilitate connections to line or load circuitry in an electrical power system.

In the example shown, the terminal elements 108, 110 are of a different shape or configuration relative to one another, with the end cap 108 including a rejection feature that cooperates with a complementary feature of a fuse holder or fuse block to ensure that that only a compatible fuse may be connected to the fuse holder or fuse block, while the end cap 110 does not include a rejection feature. In other embodiments, however, the terminal elements may instead be of the same shape or configuration.

In a contemplated example, the fuse 100 may be a Fusetron Energy Efficient, Dual-element, Class RK5 Time-delay Fuse of Bussmann by Eaton, St Louis, Mo. Variations are, of course, possible however, and the concepts below may be utilized to provide similar or different fuses, in the same or different class than RK5, than the aforementioned Fusetron fuse.

Figure 2:
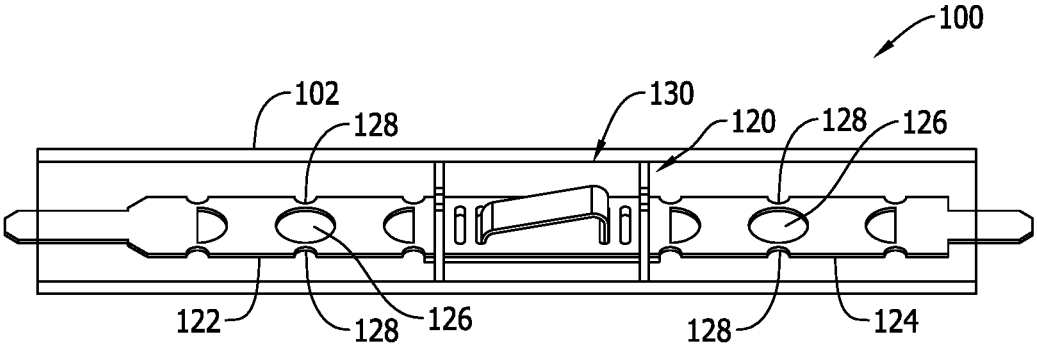
FIG. 2 is perspective view of a portion of the fuse element shown in FIG. 1 and illustrating a fuse element assembly therefor.

FIG. 2 is perspective view of a portion of the fuse 100 including the housing 102 shown as transparent and the terminal elements 108, 110 removed so that the fuse element assembly 120 inside the housing 102 can be seen. The fuse element assembly 120 in the illustrated example includes a first high overcurrent fusible element 122 and a second high overcurrent fusible element 124 with a low overcurrent fusible element 130 connected in between the elements 122, 124. Each high overcurrent fusible element 122, 124 includes as shown a generally planar conductive strip of material (e.g., a copper strip or strip of another conductive metal or alloy familiar to those in the art) formed with a number of openings 126 defining thin sections of material 128 on the edges of the openings 126, often referred to in the art as "weak spots". In high overcurrent conditions, including but not necessarily limited to short circuit conditions, the high overcurrent fusible elements 122, 124 melt at the weak spots 128 and create open circuits through the elements 122 and/or 124 in a known manner.

Exemplary geometry of the high overcurrent fusible elements 122, 124 is illustrated in FIG. 2, and the high overcurrent fusible elements 122, 124 are substantially identical to one another and extend as mirror images on either side of the low overcurrent fusible element 130. It is understood, however, that a wide variety of alternative geometries may be employed in the high overcurrent fusible elements 122, 124 to define weak spots in planar and non-planar configurations of fusible elements. Further, the high overcurrent fusible elements 122, 124 need not have the same geometry in all embodiments but instead may be differently configured from one another. In some cases one of the high overcurrent fusible elements 122, 124 may be considered optional and only one high overcurrent fusible element may be provided instead of the two elements 122, 124 shown.

Figure 3:
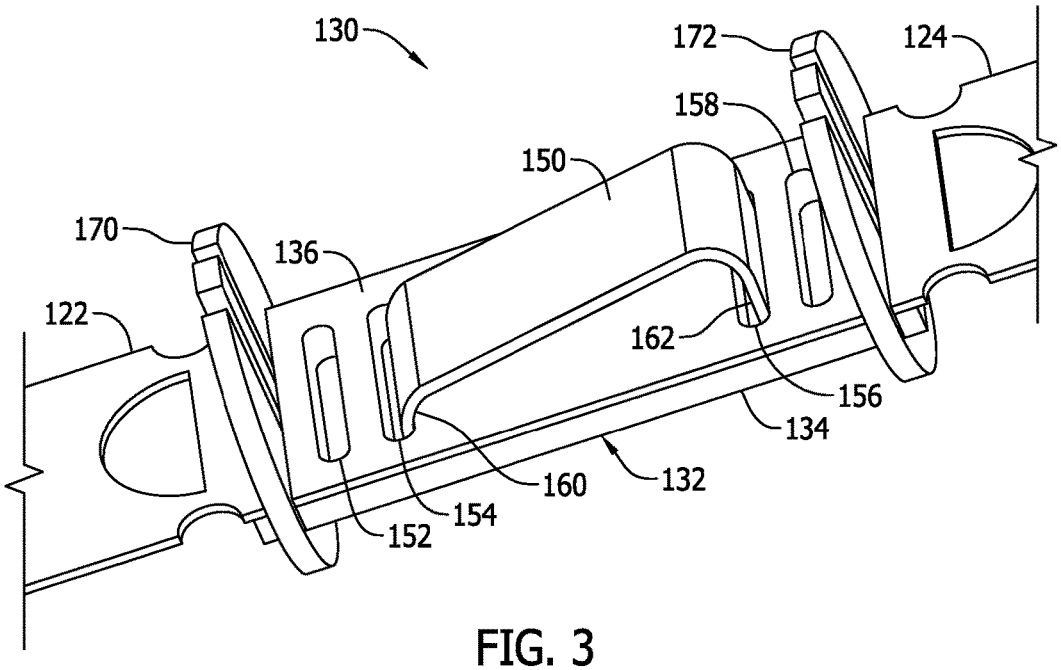
FIG. 3 is a magnified view of a portion of FIG. 2.
Figure 4:
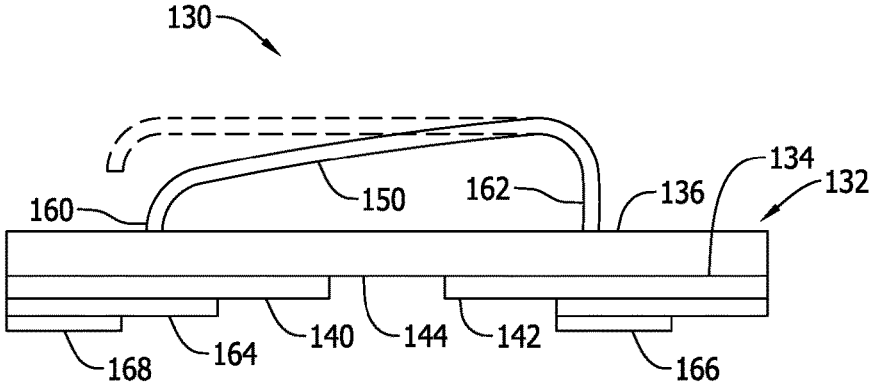
FIG. 4 is a side elevational view of the trigger assembly shown in FIG. 4.
Figure 5:
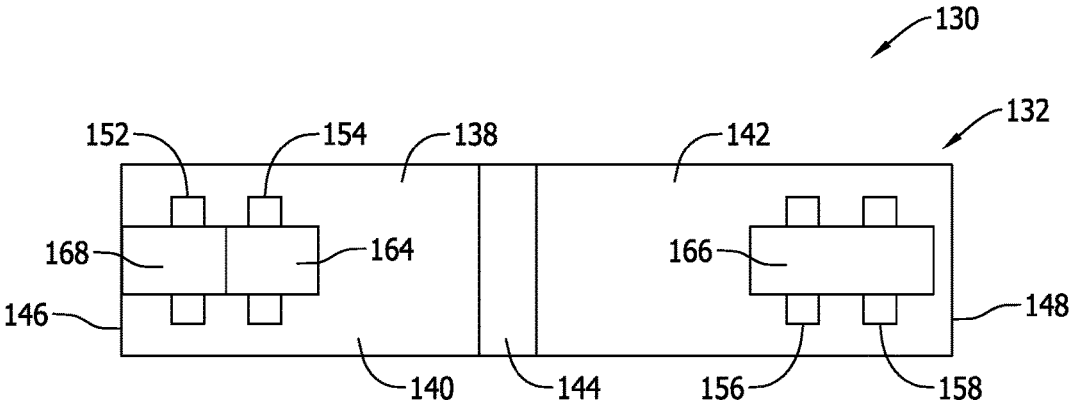
FIG. 5 is a bottom view of the trigger assembly shown in FIG. 4.

As best seen in FIGS. 3-5, the low overcurrent fusible element 130 includes a generally planar nonconductive substrate material 132 including a first major surface 134 and a second major surface 136 opposing the first major surface 134. The nonconductive substrate material 132 is relatively small and generally rectangular and may be provided at relatively low cost from substrate materials utilized in printed circuit board constructions and familiar to those in the art.

The first major surface 134 (FIGS. 4 and 5) includes a conductive layer 138 defining a first conductive portion 140 and a second conductive portion 142 separated from one another by a nonconductive gap 144 extending therebetween. As such, and because of the gap 144, there is no conductive path on the first major surface 134 that extends from the first end 146 of the material to the second end 148 of the substrate material 132. The nonconductive substrate material 132 may in contemplated embodiments be a prefabricated copper clad printed circuit board substrate with the gap 144 being formed thereon to define the first conductive portion 140 and the second conductive portion 142. Conductive materials other than copper may be utilized in other embodiments as desired. While prefabricated metal clad materials desirably simplify the manufacture of the low overcurrent fusible element 130, the substrate material 132 could instead by metallized on the major surface 134 in any manner desired and known in the art as part of the fabrication process of the low overcurrent fusible element 130.

Unlike the first major surface 134, however, the second major surface 136 of the substrate material 132 is not provided with a conductive layer and as a result the nonconductive substrate material 132 is sometimes referred to as a single-sided circuit board substrate. The single-sided circuit board material shown and described is expressly contrasted with double-side circuit board substrates having conductive layers on both sides. In some embodiments, a double-sided circuit board substrate may be obtained and the conductive material on one side may be removed to provide the single-side embodiment, or in other cases, a substrate material without any conductive material may be obtained and may be metallized on only one of the major surfaces. Regardless, the single-sided circuit board material may be prefabricated as mentioned above to simplify assembly of the low overcurrent fusible element 130 described herein and reduce costs.

On the second major surface 136 of the nonconductive substrate material 132, a releasable conductive element 150 extends across and electrically interconnects the first conductive portion 140 and a second conductive portion 142 on the first major surface 134. The releasable conductive element 150 may be, for example, a copper alloy having a shape memory that is attached to the nonconductive substrate material 132 in a first configuration shown in solid lines in FIG. 4 wherein electrical current is conducted through the releasable conductive element 150 on the second side surface 136 between the first conductive portion 140 and the second conductive portion 142 on the first major surface 134. In a contemplated embodiment, the releasable conductive element 150 may be fabricated from copper alloy C70250. While an exemplary shape and geometry is shown, other shapes and geometries of the releasable conductive element 150 are possible.

In response to a low overcurrent condition, the releasable conductive element 150 releases from the first conductive portion 140 on the major s surface 134 and assumes a second position shown in phantom lines in FIG. 4 wherein the circuit path between the releasable conductive element 150 and the first conductive portion 140 is opened such that current can no longer flow through the low overcurrent element 130.

To facilitate the releasable connection and low overcurrent fusible action described, the nonconductive substrate material 132 includes a number of openings 152, 154, 156 and 158 extending completely through the nonconductive substrate material 132 from the first major surface 134 to the second major surface 136. The openings 152, 154, 156 and 158 in the illustrated example are elongated slots at respectively spaced apart locations. The openings 152 and 154 are shown as a first pair of openings that are defined in and surrounded by the first conductive portion 140 (FIG. 5) on the first major surface 134, and the openings 156 and 158 are shown as a second pair of openings that are defined in and surrounded by the second conductive portion 142 (FIG. 5) on the first major surface 134. Other arrangements of openings, and different numbers of openings are possible in further and/or alternative embodiments.

A first end 160 of the releasable conductive element 150 is inserted into the opening 154 from the second major surface 136 and the first end 160 is connected to the first conductive portion 140 on the major surface 134 by a low melting point fusible alloy 164 via, for example, a wave soldering process. The low melting point fusible alloy 164 may be an alloy such as Sn 65, Bi 35, Pb 0.01 solder in one embodiment, although other suitable alloys are possible.

The second end 162 of the releasable conductive element 150 is inserted into the opening 156 from the second major surface 136 and the second end 162 is connected to the second conductive portion 142 on the major surface 134 by a high melting point temperature alloy 166 via, for example, a wave soldering process. As seen in FIG. 5, the high melting point temperature alloy 166 also covers the opening 156 on the second conductive portion 142. A high melting point temperature alloy 168, which may be the same or different from the alloy 166, covers the opening 152 and also a portion of the first conductive portion 140. In contemplated embodiments, the high melting temperature fusible alloys may be solder such as Sn 96, 4 Ag solder, although other suitable alloys may likewise be utilized.

As seen in FIGS. 2 and 3, an end of the high overcurrent fusible element 122 may be connected to the high melting point temperature alloy 168 via soldering techniques, and an end of the high overcurrent fusible element 124 may be connected to the high melting point temperature alloy 166 via soldering techniques. Washers 170, 172 may be provided on the ends of the nonconductive substrate material 132 as shown. When the soldered fuse assembly 130 is inside the housing 102 (FIG. 2) the high overcurrent protection elements 122, 124 may be surrounded with an arc quenching material, and the washers 170, 172 keep the arc quenching material away from the low current element to ensure its operation in a low overcurrent condition.

When assembled as described, the releasable conductive element 150 is soldered in place and anchored at both ends 160, 162 to the conductive portions 140, 142 of the nonconductive substrate material 132. When connected to an energized electrical power system, electrical current flows from the first terminal element 108 (FIG. 1) to and through the high overcurrent element 122, to and through the conductive portion 140 to the end 160 of the releasable conductive element 150 via the fusible alloys 164 and 168, through the releasable element 150 to the second conductive portion 142 and the fusible alloy 166, to and through the second high overcurrent element 124 and to the terminal 110.

When subjected to high overcurrent conditions, including but not necessarily limited to a short circuit condition, the high overcurrent elements 122, 124 open at the weak spots 128 before the low overcurrent fusible element 130 can physically respond. Opening of the elements 122, 124 protects circuitry connected to the fuse from an otherwise damaging high overcurrent condition.

When subjected to a low overcurrent condition (i.e., a comparatively lower current magnitude than the high current condition but sustained over a predetermined period of time), the low temperature melting point alloy 164 (FIGS. 4 and 5) is heated by the overcurrent and softens and weakens to the point of release of the end 160 of the releasable conductive element 150. Once released, the element 150 deflects away from the substrate 132 and the circuit is opened between the conductive portions 140 and 142 to protect downstream circuitry from the low overcurrent condition. The higher melting point fusible alloys 166, 168 remain intact, however, to ensure that the opening occurs via deflection of the element 150. The high overcurrent fusible elements 122, 124 likewise remain intact in low overcurrent conditions.

Relative to existing trigger devices serving similar purposes to provide low overcurrent protection, the low overcurrent fusible element 130 is comparatively simpler and easier to fabricate at reduced cost with improved reliability. For example considering the conventional trigger assembly noted above including 8 component parts, the low overcurrent fusible element 130 essentially involves two pre-fabricated components in contemplated embodiments, namely the releasable spring-conductor 150 that is mounted to the small, single-sided circuit board substrate described.

Also considering that the conventional trigger assembly noted above including 8 component parts is hand assembled by 8 different persons, the assembly of the low overcurrent fusible element 130 is much more amenable to automation at lower cost with improved quality and reliability.

Because the releasable element 150 in the low overcurrent fusible element 130 is part of the current path through the fuse 100, automated testing of the fuse 100 is possible to ensure that the releasable element 150 has been correctly installed by passing current through the fuse. If the releasable element 150 is missing or not soldered correctly, no current will pass through the fuse and assembly issues can be simply and reliably detected and corrected. In contrast in the conventional trigger assembly noted above including 8 component parts, the coil spring is not part of the current path and is not amenable to such testing to detect a presence and proper installation of the coil spring.

The benefits and advantages of the inventive concepts disclosed are now believed to have been amply illustrated in relation to the exemplary embodiments disclosed.

An embodiment of an electrical fuse has been disclosed including: a housing; at least one high overcurrent fusible element and a low overcurrent fusible element connected to one another inside the housing. The low overcurrent fusible element includes: a nonconductive substrate material including a first major surface and a second major surface opposite the first major surface; a conductive layer provided on the first major surface of the nonconductive substrate material, the conductive layer defining a first conductive portion and a second conductive portion separated from one another; and a releasable conductive element extending on the second major surface of the nonconductive substrate material, the releasable conductive element including a first end electrically connecting to the first conductive portion on the first major surface and a second end electrically connecting to the second conductive portion on the first major surface.

Optionally, the nonconductive substrate material may include a first opening extending through the nonconductive substrate material from the first major surface to the second major surface, and the first end of the releasable conductive element extends in the first opening. The fuse may also include a low melting point fusible material electrically connecting the first end of the releasable conductive element and the first conductive portion. The nonconductive material may include a second opening spaced from the first opening in the nonconductive substrate material, and the second opening may extend through the nonconductive substrate material from the first major surface to the second major surface. The electrical fuse may also further include a high melting point fusible material extending across the second opening, and the second end of the releasable conductive element in the second opening, and wherein the high melting point fusible material electrically connects the second end of the releasable conductive element and the second conductive portion.

As further options, the nonconductive substrate material may include a first opening, a second opening, a third opening, and a fourth opening respectively extending through the nonconductive substrate material from the first major surface to the second major surface at respectively spaced apart locations. The first conductive portion may extend around the first opening and the second opening, and the second conductive portion may extend around the third opening and the fourth opening. The electrical fuse may include a high melting point fusible material applied over the first opening and a low melting point fusible material applied over the second opening. A first end of the releasable conductive element may be attached to the low melting point fusible material through the second opening. The electrical fuse may further include a high melting point fusible material applied over each of the third opening and the fourth opening. A second end of the releasable conductive element may be attached to the high melting point fusible material through the third opening.

The releasable conductive element may be a strip of conductive shape memory material. The strip of conductive shape memory material may be a copper alloy.

The at least one high overcurrent fusible element may include a strip of material defining a plurality of weak spots. The at least one high overcurrent fusible element may also include a pair of high overcurrent fusible elements, with the low overcurrent fusible element connected in between the first and second high overcurrent fusible elements in the housing.

The housing of the electrical fuse may be substantially cylindrical. The electrical fuse may also include first and second terminal elements coupled to the housing, and the at least one high overcurrent fusible element and the low overcurrent fusible element may define a circuit path between the first and second terminal elements. The first and second terminal elements may include first and second end caps. The conductive layer may include copper.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An electrical fuse comprising:

a housing; and a low overcurrent fusible element connected in series between a first high overcurrent fusible element and a second high overcurrent fusible element inside the housing, wherein the low overcurrent fusible element comprises:

a nonconductive substrate having a first major surface and a second major surface opposite the first major surface;

a conductive layer provided on the first major surface of the nonconductive substrate, the conductive layer defining a first conductive portion and a second conductive portion separated from one another by a nonconductive gap, wherein each of the first conductive portion and the second conductive portion is series connected to a respective one of the first high overcurrent fusible element and the second high overcurrent fusible element and wherein the second major surface of the nonconductive substrate is not provided with a conductive layer;

a releasable conductive element extending on the second major surface of the nonconductive substrate, the releasable conductive element including a first end and a second end;

a low melting point solder extending on the first major surface of the nonconductive substrate without extending on the second major surface of the nonconductive substrate, the low melting point solder establishing a first current path from the first conductive portion on the first major surface of the nonconductive substrate to the first end of the releasable conductive element; and a high melting point solder extending on the first major surface of the nonconductive substrate without extending on the second major surface of the nonconductive substrate, the high melting point solder establishing a second current path between the second end of the releasable conductive element and the second conductive portion on the first major surface.

2. The electrical fuse of claim 1, wherein the nonconductive substrate includes an opening extending through the nonconductive substrate from the first major surface to the second major surface, the first end of the releasable conductive element extending in the opening from the second major surface of the nonconductive substrate.

3. The electrical fuse of claim 2, further wherein the low melting point solder extends across the opening and the first conductive portion on the first major surface of the nonconductive substrate.

4. The electrical fuse of claim 2, wherein the nonconductive substrate material includes an opening extending through the nonconductive substrate material from the first major surface to the second major surface, the second end of the releasable conductive element extending in the opening from the second major surface of the nonconductive substrate.

5. The electrical fuse of claim 4, wherein the high melting point solder extends across the opening and the second conductive portion on the first major surface of the nonconductive substrate.

6. The electrical fuse of claim 5, wherein the high melting point solder defines a current path between the second end of the releasable conductive element and the second conductive portion on the first major surface of the nonconductive substrate.

7. The electrical fuse of claim 1, wherein the nonconductive substrate includes four openings respectively extending through the nonconductive substrate from the first major surface to the second major surface at respectively spaced apart locations.

8. The electrical fuse of claim 7, wherein the first conductive portion extends around a first pair of the four openings on the first major surface of the nonconductive substrate, and wherein the second conductive portion extends around a second pair of the four openings on the first major surface of the nonconductive substrate.

9. The electrical fuse of claim 8, wherein the high melting point solder is applied over the second conductive portion on the first major surface of the nonconductive substrate and the low melting point solder is applied over the first conductive portion on the first major surface of the nonconductive substrate.

10. The electrical fuse of claim 9, wherein the first end of the releasable conductive element is attached to first conductive portion on the first major surface of the nonconductive substrate via the low melting point solder.

11. The electrical fuse of claim 8, further comprising a high melting point fusible material applied over the low melting point solder on the first major surface of the nonconductive substrate.

12. The electrical fuse of claim 11, wherein a second end of the releasable conductive element is attached to the second conductive portion on the first major surface of the nonconductive substrate via the high melting point solder.

13. The electrical fuse of claim 1, wherein the releasable conductive element comprises a strip of conductive shape memory material.

14. The electrical fuse of claim 13, wherein the strip of conductive shape memory material comprises a copper alloy.

15. The electrical fuse of claim 1, wherein each of the first and second high overcurrent fusible elements comprises a strip of material defining a plurality of weak spots.

16. The electrical fuse of claim 1, wherein the housing is substantially cylindrical.

17. The electrical fuse of claim 1, further comprising first and second terminal elements coupled to the housing and connected to each respective one of the first and second high overcurrent fusible elements.

18. The electrical fuse of claim 17, wherein the first and second terminal elements comprise first and second end caps.

19. The electrical fuse of claim 1, wherein the conductive layer comprises copper.

* * * * *